US005678313A

United States Patent [19]

Tezuka et al.

[11] Patent Number: 5,678,313

[45] Date of Patent: Oct. 21, 1997

[54] TRIPLE BLADED SHAVER

[75] Inventors: Yoshitaka Tezuka, Tsuna-gun; Kiyotaka Mukai, Sumoto, both of Japan

[73] Assignee: Sanyo Electric Co., Ltd., Osaka, Japan

[21] Appl. No.: 547,612

[22] Filed: Oct. 24, 1995

[30] Foreign Application Priority Data

| | | | |
|---|---|---|---|
| Oct. 31, 1994 | [JP] | Japan | 6-266636 |
| Oct. 31, 1994 | [JP] | Japan | 6-266644 |
| Oct. 31, 1994 | [JP] | Japan | 6-266646 |
| Oct. 31, 1994 | [JP] | Japan | 6-266647 |

[51] Int. Cl.[6] ..... B26B 19/04

[52] U.S. Cl. ..... 30/43.42

[58] Field of Search ..... 30/43.92, 43.2, 30/346.31, 43.91

[56] References Cited

U.S. PATENT DOCUMENTS

| | | | |
|---|---|---|---|
| 5,185,926 | 2/1993 | Locke | 30/43.92 |
| 5,189,792 | 3/1993 | Otsuka et al. | 30/43.92 |
| 5,367,771 | 11/1994 | Mukai | 30/43.92 |

FOREIGN PATENT DOCUMENTS

| | | |
|---|---|---|
| 1 159 309 | 12/1963 | Germany . |
| 43 03 426 | 9/1993 | Germany . |
| 43 13 371 | 10/1993 | Germany . |
| WO 93/12916 | 7/1993 | WIPO . |

*Primary Examiner*—Douglas D. Watts
*Attorney, Agent, or Firm*—Wenderoth, Lind & Ponack

[57] ABSTRACT

The triple bladed shaver is provided with three rows of mesh outer blades and inner blades that press against the inside surfaces of the outer blades. The three blade rows are mutually parallel with the center blade projecting outward more and having a longer in-out stroke than the side blades. The outer blades move freely and independently in and out of an outer blade case to which they connect. Edge springs between the center outer blade and the outer blade case push the center blade outward at both ends. The unique structure achieves comfortable efficient shaves.

17 Claims, 13 Drawing Sheets

TRIPLE BLADED SHAVER

BACKGROUND OF THE INVENTION

This invention relates to a triple bladed shaver having three rows of inner and outer blades, and in particular relates to a triple bladed shaver wherein the outer blade at the center projects outward more than the outer blades on either side.

Triple bladed shavers have previously been developed. A shaver with three rows of outer blades disposed in the same plane allows the three outer blades to contact the skin when the shaver is oriented perpendicular to the skin. However, when this type of shaver is inclined with respect to the skin, only one blade row can contact the skin. This drawback can be solved by making the center outer blade project outward more than the outer blades on either side. When a triple bladed shaver with an outward projecting center blade is inclined with respect to the skin, two outer mesh blades come in contact with the skin. Further, by making the in-out stroke of the center blade longer than that of the blades on either side, a triple bladed shaver of this configuration can shave with all three outer mesh blades in contact with the skin when the shaver is near perpendicular. A triple bladed shaver wherein the outer blades project flexibly outward in this fashion is in demand.

A shaver configured with the outer blades projecting flexibly outward is recited in Japanese Non-examined Patent Publication No. 5-309181 issued Nov. 22, 1993. As shown in FIG. 1, the shaver disclosed has two rows of outer blades 1 connected in parallel by links 2 to an outer blade case 3 in a manner allowing free up and down movement. The two outer blades 1 are connected to the links 2 such that they can move up and down independently. The links 2 in turn are connected to the outer blade case 3 such that they have free parallel movement up and down. The links 2 are made of plastic with thin areas which form elastically deformable sections 2A.

When the outer mesh blades 1 of this type of electric shaver are pushed against the skin, the elastically deformable sections 2A of the links 2 distort to allow the two rows of outer blades move up and down independently. The two rows of outer blades push evenly against the skin due to distortion of the elastically deformable sections 2A of the links 2.

A system provided with elastically deformable links disposed at the ends of an outer blade case enable two rows of outer blades to flexibly push against the skin. However, extension of this configuration to enable three rows of outer blades to flexibly push against the skin results in an extremely complex structure which in practice is impossible to implement.

Another shaver with two rows of outer blades that flexibly push against the skin has been developed with elastically deformable sections formed from plastic as a single piece with the outer blade case (Japanese Non-examined Patent Publication No. 5-293260 issued Nov. 9, 1993). However, extension of this structure to flexibly push outwards three rows of outer blades with elastically deformable sections formed as a single piece with the outer blade case is extremely difficult. This is due to the difficulty in designing a single-piece outer blade case structure which allows each of three outer blade rows to flexibly push outward independently.

Consequently, it is extremely difficult to design a triple bladed shaver wherein the center outer blade pushes flexibly outward from the outer blade case. For this reason, prior art shavers are configured with the center outer blade pushed flexibly outward by the inner blade which pushes against the outer blade's inner surface. An abbreviated cross-sectional view of an inner blade which pushes flexibly outward on an outer blade is shown in FIG. 2. As shown in FIG. 2, the inner blade row 26 is connected to the inner blade stage by a center spring 25, and the center spring 25 pushes the inner blade 26 flexibly outward. A triple bladed shaver with a center spring 25 which lifts the inner blade 26 and pushes the center outer blade 21 flexibly outward has the drawback that when the ends of the outer blade 21 are pushed, as shown by the arrows A and B in FIG. 2, the outer blade slants and does not push smoothly outward from the outer blade case. This is because the center spring 25 pushes on the inner blade 26 only at its center region.

The present invention was developed to further solve the above mentioned problems. It is thus a primary object of the present invention to provide a triple bladed shaver wherein the center outer blade pushes outward from the outer blade case against the skin in an even, balanced fashion.

The above and further objects and features of the invention will more fully be apparent from the following detailed description with accompanying drawings.

SUMMARY OF THE INVENTION

To realize the above mentioned object, the triple bladed shaver of present invention is provided with the following structure. The triple bladed shaver is provided with three rows of outer blades and with inner blades which are pushed against the inner surfaces of the outer blades. The outer blades are mesh cutters which are curved in arch shapes and connected to blade supports formed of plastic. The three outer blades are arranged in parallel rows and inserted in an outer blade case in a manner allowing them to move in and out. The center outer blade row projects out further from the outer blade case than the outer blade rows on either side.

Further, the center outer blade has edge springs disposed at outer blade ends between the outer blade and the outer blade case. The edge springs located at both ends of the outer blade flexibly project the outer blade from the outer blade case to push flexibly against the skin.

DETAILED DESCRIPTION OF THE INVENTION

Figure 1:
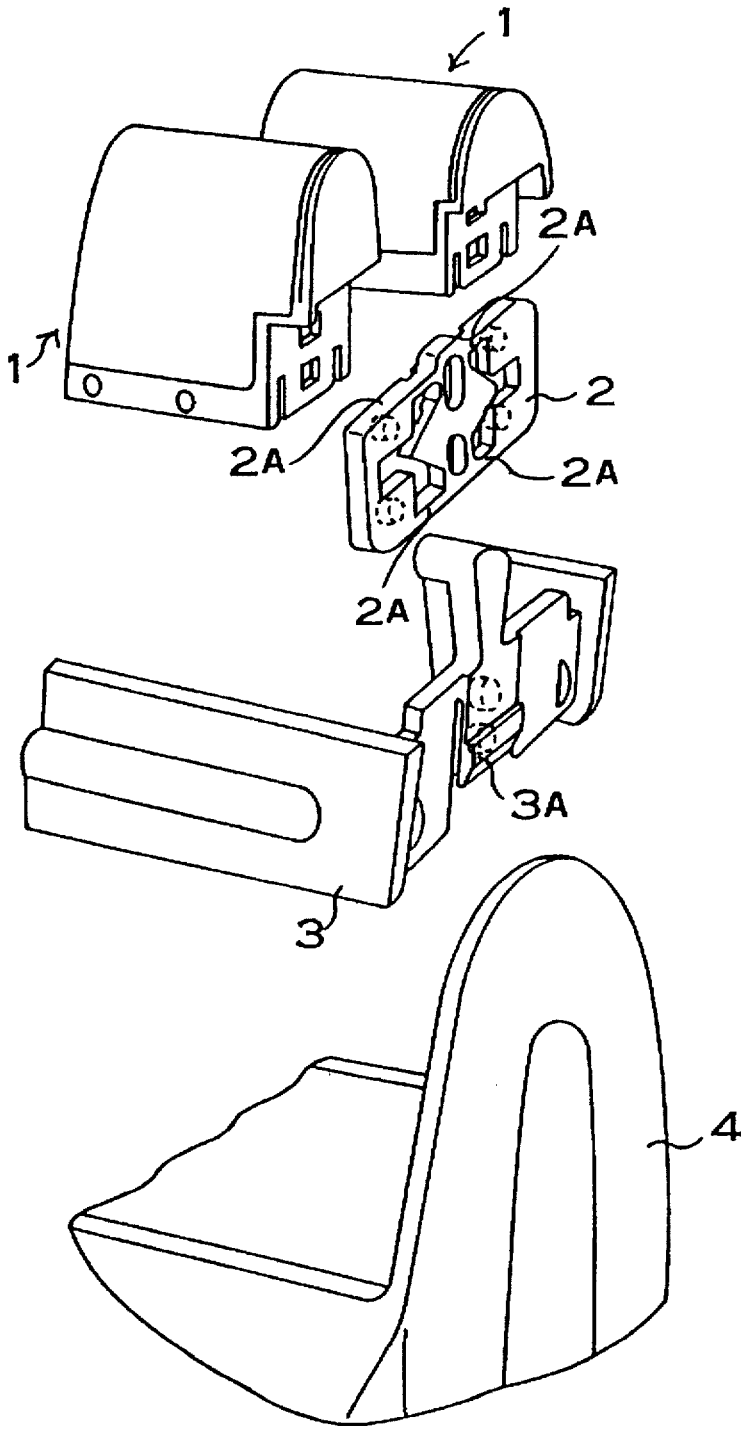
FIG. 1 PRIOR ART
FIG. 1 is an oblique view showing a prior art double bladed shaver.
Figure 2:
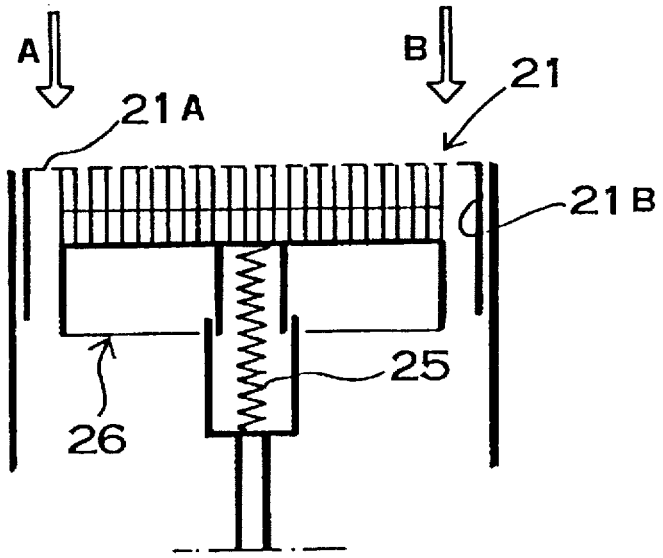
FIG. 2 PRIOR ART
FIG. 2 is an abbreviated cross-sectional view sectioned vertically down the center inner blade of a prior art triple bladed shaver.
Figure 3:
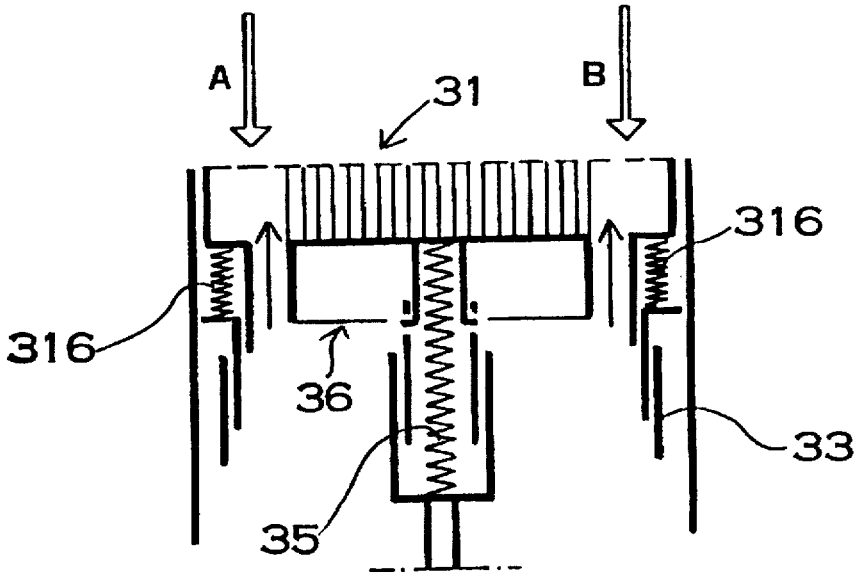
FIG. 3 is an abbreviated cross-sectional view sectioned vertically down the center inner blade of an embodiment of the triple bladed shaver of the present invention.

The triple bladed shaver of the present invention is characterized in that outer blades are flexibly pushed upon by edge springs. This is shown diagramatically in FIG. 3. FIG. 3 is a vertical cross-sectional view through the center outer blade of the triple bladed shaver. In this figure, the center outer blade 31 is provided with edge springs 316 disposed at both ends between the outer blade 31 and the outer blade case 33. The edge springs 316 independently project each end of the outer blade 31 outward in a flexible fashion. Consequently, even when an end of the outer blade 41 is pressed down as shown by arrow A or arrow B in FIG. 3, the respective edge spring 316 pushes the blade outwards for comfortable skin contact. In particular, the center outer blade 31 with edge springs 316 at both ends can have a larger in and out stroke and still press comfortably against the skin.

FIGS. 4 through 7 show the overall triple bladed shaver assembly. As shown in these and other figures, the triple bladed shaver is provided with three rows of outer blades 41, an outer blade case 43 which retains the outer blades 41 in a removable fashion, an outer blade frame 44 which retains the outer blade case 43 in a removable fashion, three rows of inner blades 46 which are pressed against the inner surfaces of the outer blades 41 and moved in a sliding fashion, an inner blade stage 11 to which the inner blades 46 are connected, and a driving mechanism which moves the inner blade stage 11 in reciprocal motion.

Figure 4:
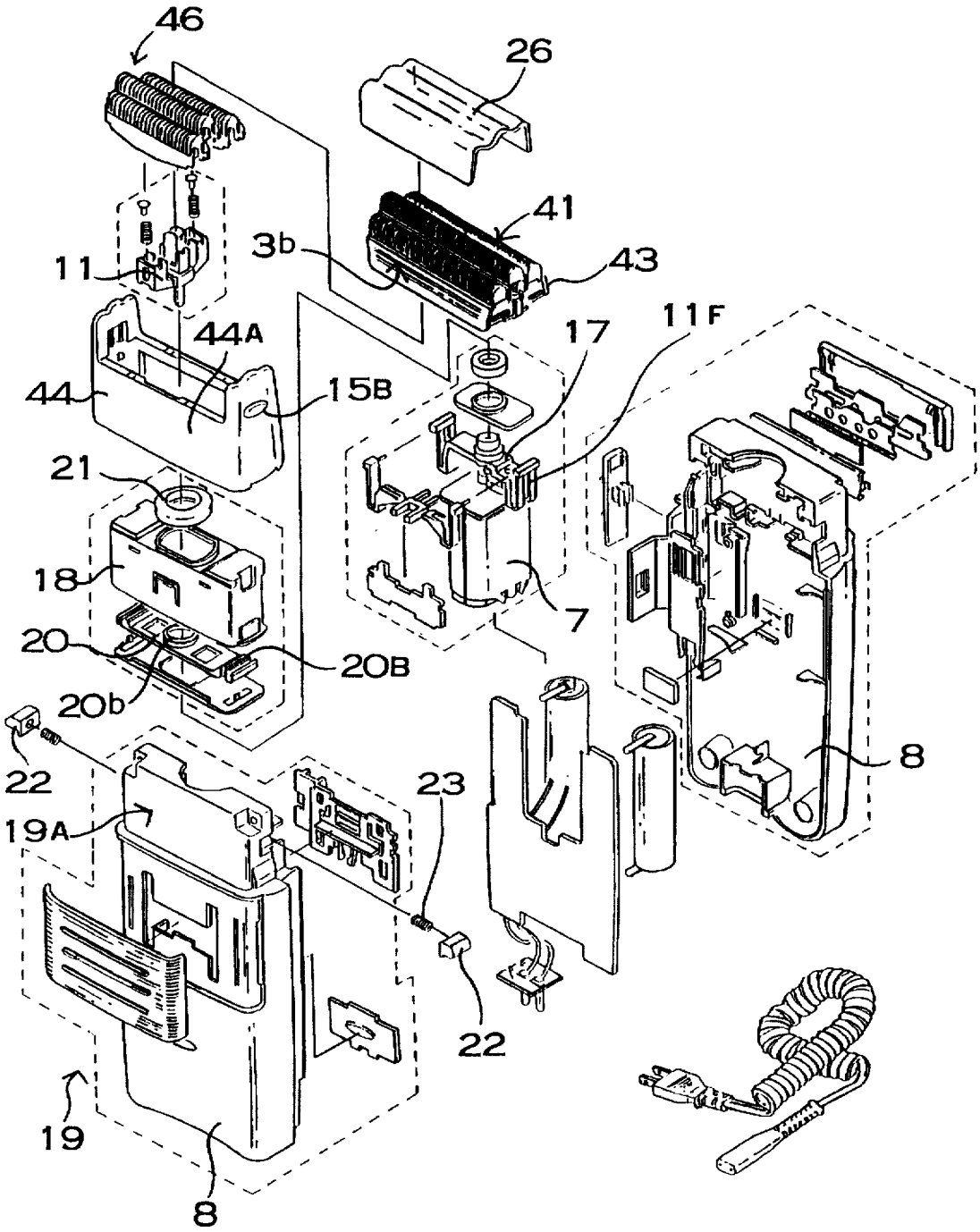
FIG. 4 is an exploded oblique view showing major elements of an embodiment of the triple bladed shaver of the present invention.
Figure 7:
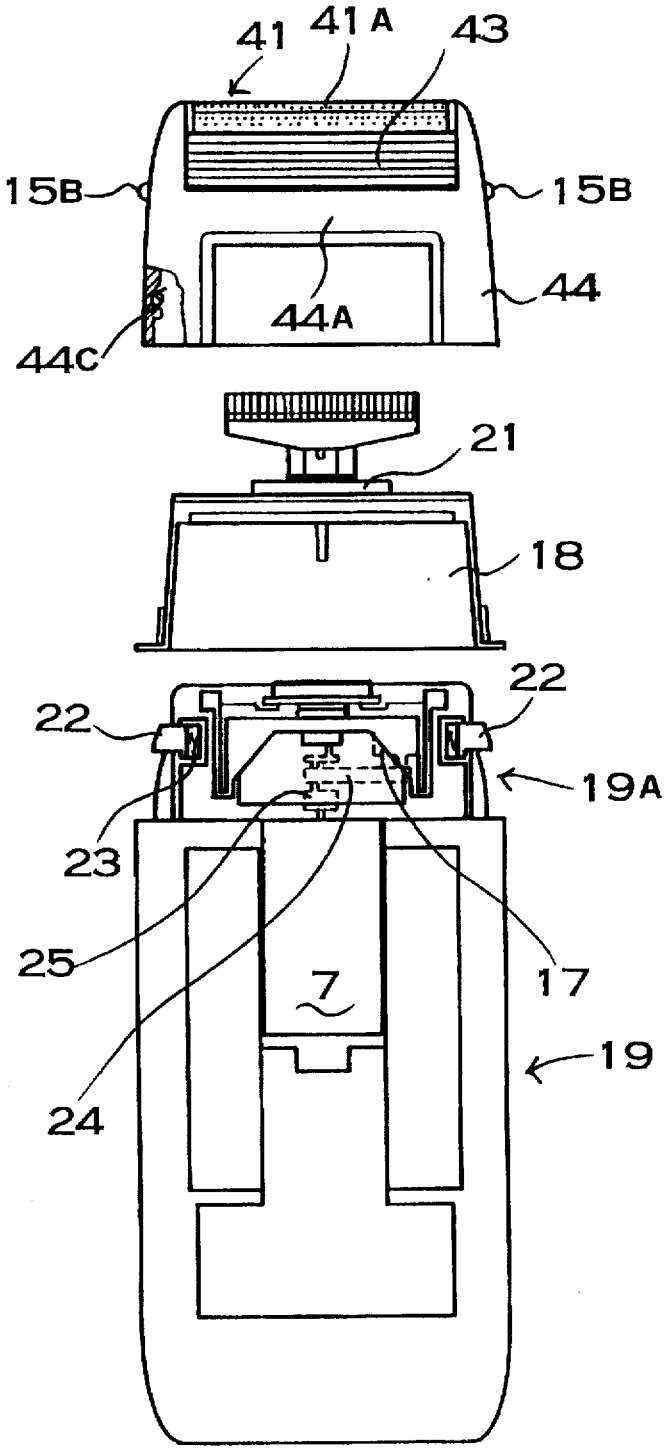
FIG. 7 is an exploded front view of the electric razor shown in FIG. 6.
Figure 8A:
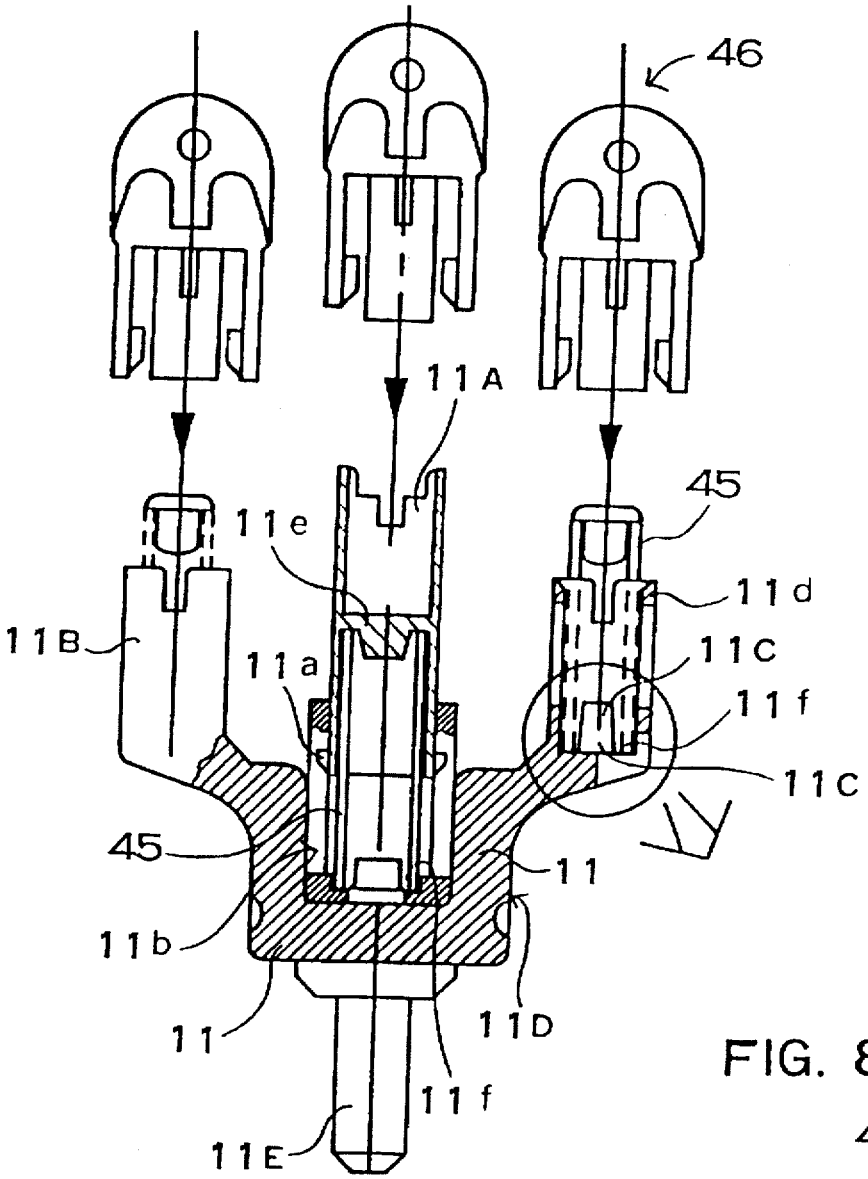
FIGS. 8(*a–b*) is a side view partly in cross-section of the three rows of inner blades and the inner blade stage.
Figure 8B:
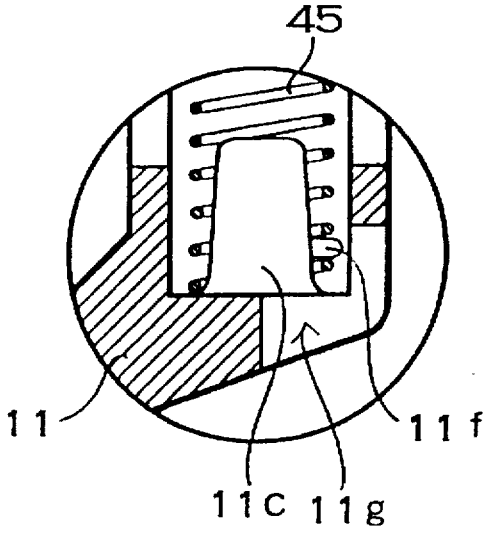
Figure 9:
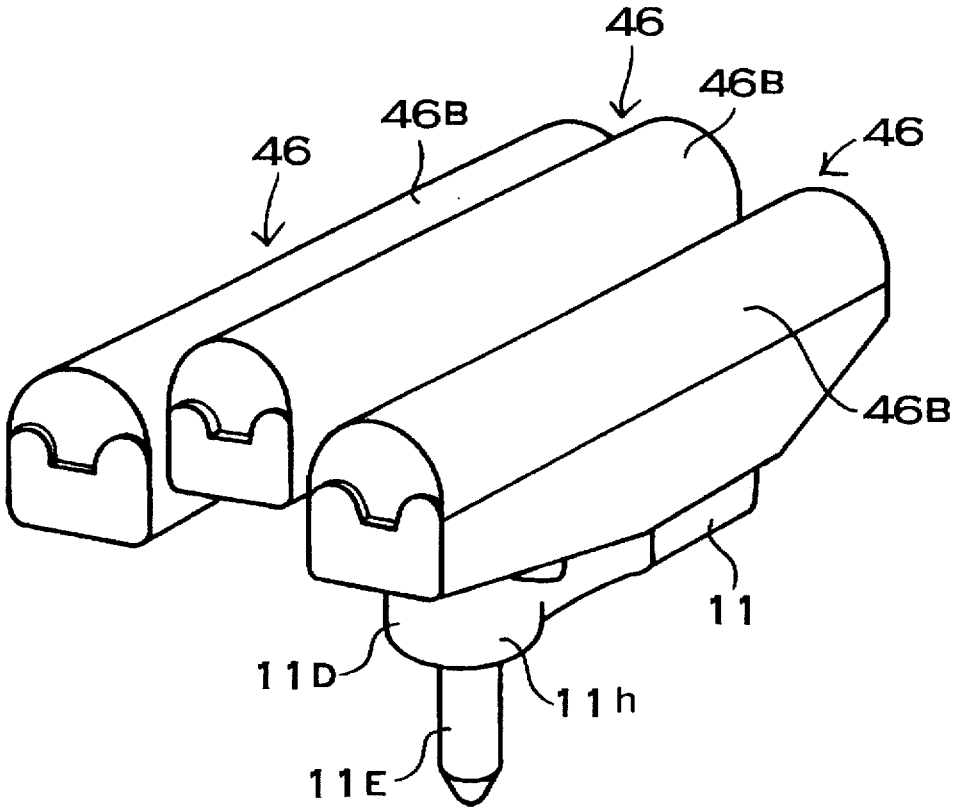
FIG. 9 is an oblique view of the inner blades and the inner blade stage shown in FIG. 8.

As shown in FIGS. 8 and 9, the three rows of inner blades 46 are connected to the inner blade stage 11. As shown in FIGS. 4 and 7, the inner blade stage 11 is moved in reciprocal motion by the driving mechanism housed within the case 8.

Figure 10:
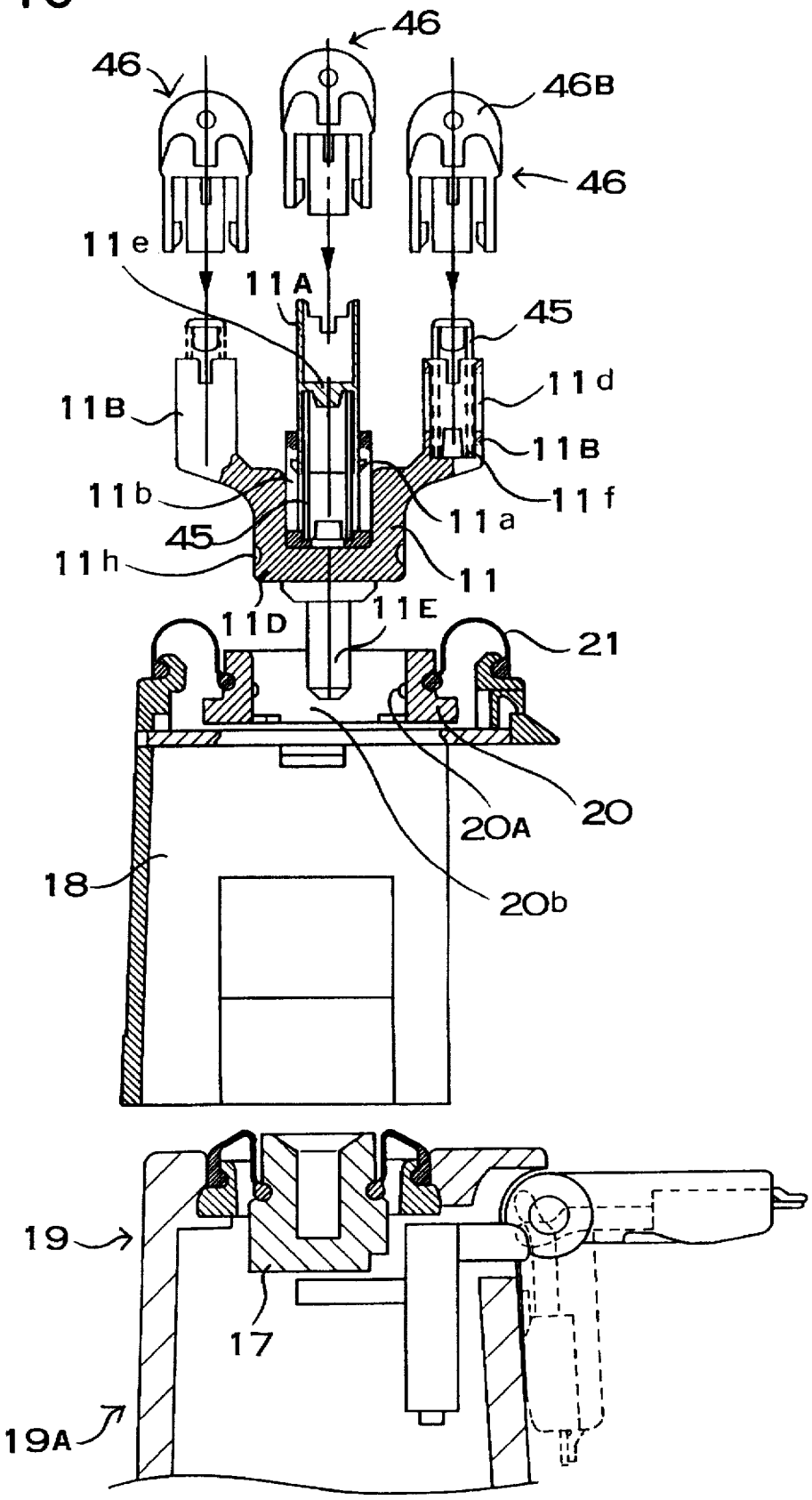
FIG. 10 is a cross-sectional view of the inner blade connecting section of the triple bladed shaver shown in FIGS. 4 and 5.

As shown in FIG. 10, a coupling rod 11E is fixed to the bottom of the inner blade stage 11 such that it projects downward and mates with the vibrator 17 in the body 19 of the electric shaver. The coupling rod 11E is made of metal and fits into the coupling hole of the vibrator 17 without any gaps.

Further, the lower portion of the inner blade stage 11 is formed into a connecting plug 11D which mates in a removable fashion with a sub-vibrator stage 20 of the blade holder 18. As shown in the oblique view of FIG. 11 and the bottom view of FIG. 12, connecting grooves 11*h* are provided on opposite sides of the lower portion of the connecting plug 11D. Here it is noted that the oblique projection of FIG. 11 portrays the up-down stage 11A and the vertical columns 11B as being larger than the connecting plug 11D. Projections 20A provided on the sub-vibrator stage 20 insert into the connecting grooves 11*h* on the connecting plug 11D to mate the inner blade stage 11 to the sub-vibrator stage 20 in a manner that will not pull apart. The inner blade stage 11 can be separated from the sub-vibrator stage 20 by rotating it 90°. The mechanism for this type of connection is realized, as shown in the bottom view of FIG. 12, by parallel flats 11*k* established between connecting grooves 11*h* on the connecting plug 11D. Since the connecting plug 11D width is narrower between flats 11*k* than between connecting grooves 11*h*, the inner blade stage 11 can be easily separated from the sub-vibrator stage 20 by rotating the inner blade stage 11 to align the projections 20A with the flats 11*k*. The inner blade stage 11 connects to the sub-vibrator stage 20 by inserting the connecting plug 11D into the sub-vibrator stage 20 with the flats 11*k* aligned with the projections 20A and rotating the inner blade stage 11 90°. The projections 20A and the flats 11*k* are oriented such that the inner blade rows 46 are parallel to the outer blade rows when the inner blade stage 11 is connected to the sub-vibrator stage 20 and the inner blade rows 46 are perpendicular to the outer blade rows during insertion or disconnection.

As shown in FIGS. 4 and 7, the blade holder 18 mounts on the upper portion of the electric shaver body 19 in a removable fashion. The blade holder 18 fits tightly into the outer blade frame 44 and connects to the electric shaver body 19. Specifically, the blade holder 18 connects to the electric shaver body 19 by being sandwiched between the inside of the outer blade frame 44 and the outside of the shaver body 19. The blade holder 18 is a plastic assembly that houses the sub-vibrator stage 20 capable of reciprocating motion in the horizontal direction.

As shown in FIG. 4, the sub-vibrator stage 20 is formed from plastic in a single piece with integrated flexible supports 20B at each end capable of elastic deformation. The flexible supports 20B connect the ends of the sub-vibrator stage 20 to the blade holder 18 and support it in a manner that allows reciprocal motion of the stage in the direction of inner blade 46 vibration. To prevent beard cuttings from entering the space between the sub-vibrator stage 20 and the blade holder 18, the top of this gap is closed off by a rubber sealing ring 21. The inner circumference of the sealing ring 21 mates with the inner blade stage 11 and the outer circumference connects to the blade holder 18.

As shown in FIG. 10, the connecting plug 11D of the inner blade stage 11 inserts into the sub-vibrator stage 20. Further, the sub-vibrator stage 20 has a through hole 20*b* pierced through its center to allow the coupling rod 11E to pass through to the vibrator 17. The through hole 20*b* has an inside diameter designed to accept the connecting plug 11D of the inner blade stage 11 without any gap or play. The inner surface of the through hole 20*b* is formed with projections 20A to fit into the connecting grooves 11*h* on the connecting plug 11D. The projections 20A are oriented on opposing surfaces to mate with the connecting grooves 11*h* when the connecting plug 11D of the inner blade stage 11 is inserted into the through hole 20*b* and the inner blades 46 are aligned parallel to the outer blades.

As shown in FIGS. 4 and 7, the electric shaver body 49 has an adapter section 19A at its upper portion for attaching the blade holder 18 and the outer blade frame 44 in a removable fashion. As shown in FIG. 7, the adapter section 19A is provided with outward projecting spring loaded latches 22. The spring loaded latches 22 hold the blade holder 18 and the outer blade frame 44 to the adapter section 19A in a simple effective manner. The blade holder 18 and the outer blade frame 44 can be separated from the electric shaver body 19 with a strong pull. This is because the spring loaded latches 22 will depress inward with a strong pull. The spring loaded latches 22 pass through the blade holder 18 and flexibly insert into frame cavities 44C in the inner surface of the outer blade frame 44 to connect the blade holder 18 and the outer blade frame 44 to the electric shaver body 19. The spring loaded latches 22 are pushed flexibly outward by coiled compression springs 23. The compression springs 23 apply pressure to the backsides of the spring loaded latches 22.

Figure 13:
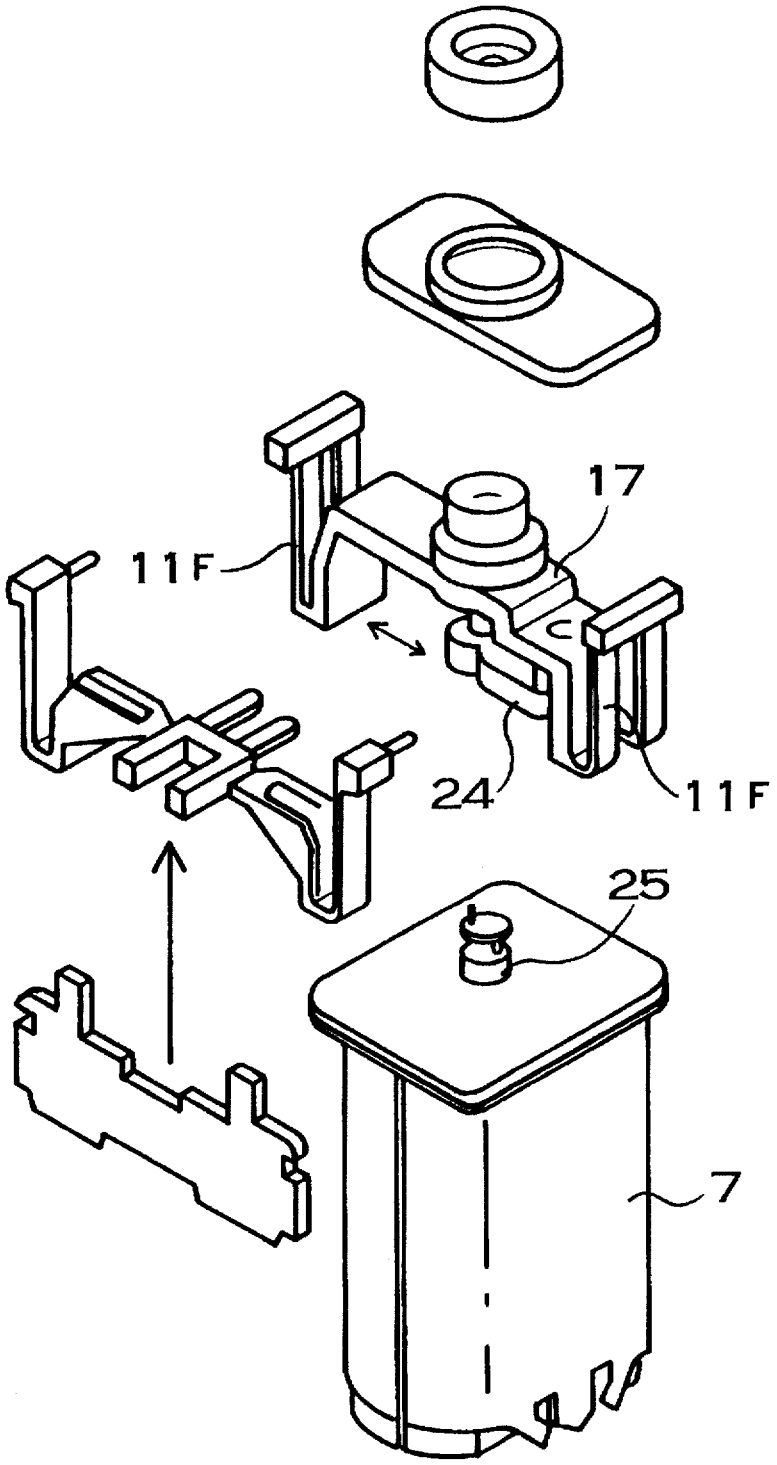
FIG. 13 is an oblique view showing the section where the motor induces reciprocating motion of the vibrator.

The adapter section 19A houses the vibrator 17 which moves the inner blade stage 11 in reciprocating motion. As shown in FIG. 13, the vibrator 17 is plastic and is formed as a single piece with elastically deformable flexible arms 11F at both ends. The vibrator 17 connects with the case of the electric shaver body 19 via the deformable flexible arms 11F in a manner that allows reciprocating motion. As shown in FIG. 13, the vibrator 17 is connected via a connecting rod 24 to an eccentric axis of a cam 25 which is fixed to the shaft of the motor 7. When the motor 7 rotates, the cam 25 rotates and the vibrator 17 is moved in reciprocating motion by virtue of the eccentric axis of the cam 25 and the connecting rod 24.

Figure 5:
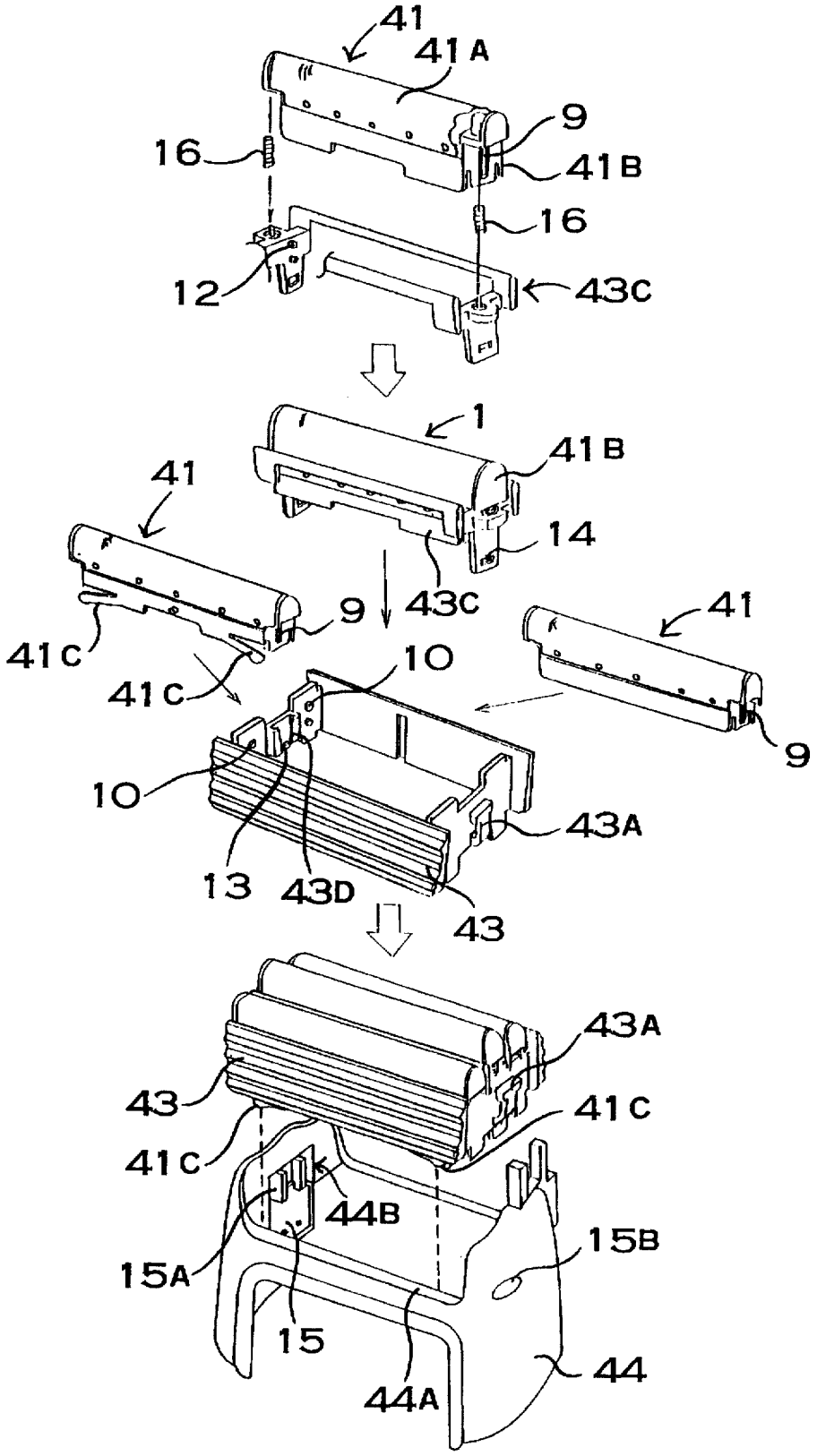
FIG. 5 is an exploded oblique view showing major elements of an embodiment of the triple bladed shaver of the present invention.
Figure 6:
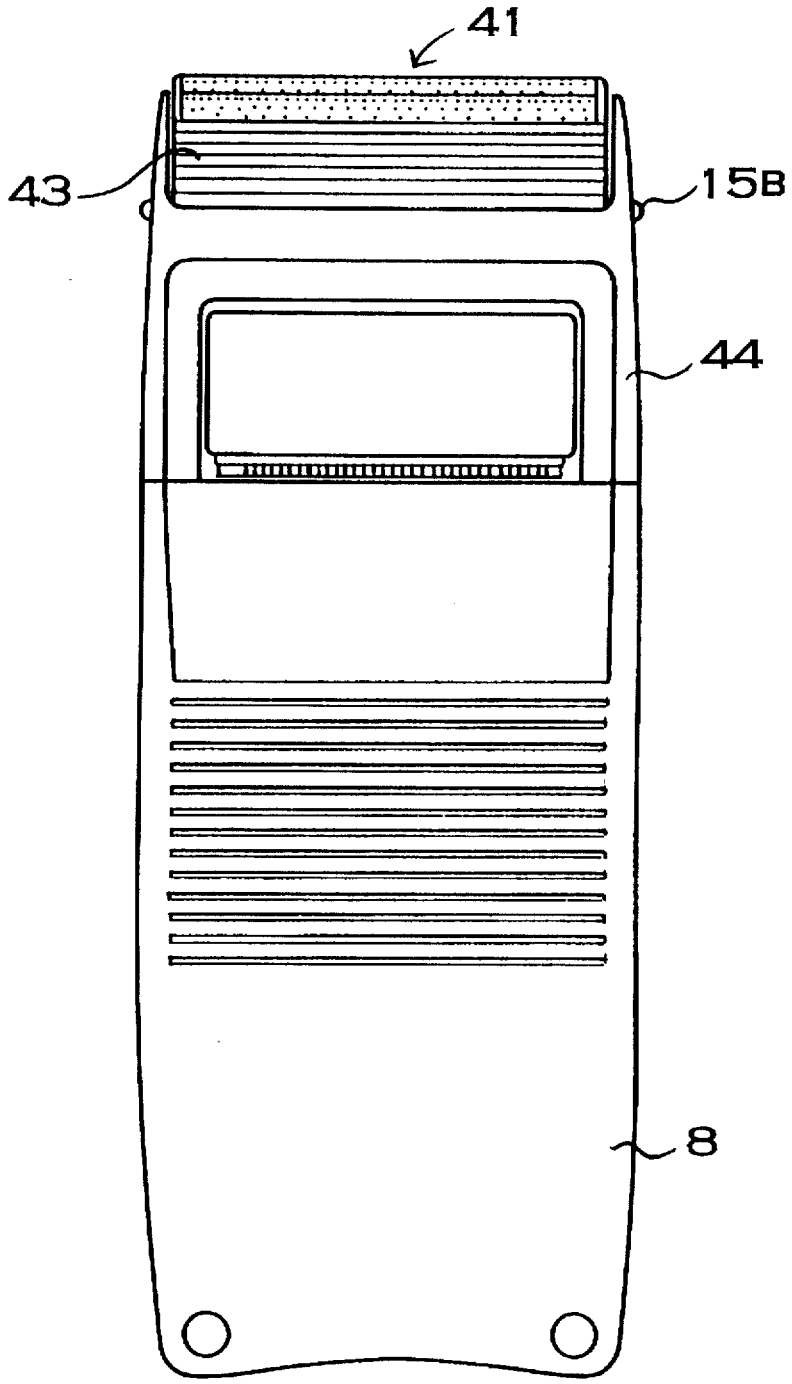
FIG. 6 is a front view of an embodiment of the triple bladed shaver of the present invention.

The three rows of outer blades 41 are mounted independently in the outer blade case 43. As shown in FIG. 5, each outer blade 41 comprises a plastic blade support 41B with a mesh cutter 41A affixed thereto. The thin metal mesh cutters 41A are fastened to blade supports 41B which curve in arched shapes. The blade supports 41B are made of hard plastic and formed in the shape of rectangular cylinders open at the top and bottom.

The blade supports 41B for the outer blades 41 on either side of center are formed as a single piece with elastically deformable struts 41C projecting from the bottom surfaces of the outer edges. These elastically deformable struts 41C push the outer blades 41 outward. The elastically deformable struts 41C are rod-shaped and slope downward from the center regions of the blade supports 41B towards the ends. As shown in FIG. 5, a blade support 41B with elastically deformable struts 41C provided at each end has the characteristic that the outer blade 41 can be moved in a parallel fashion.

The ends of the elastically deformable struts 41C press against the upper edges 44A of the opening in the outer blade frame 44 to push the outer blades 41 outwards towards the skin. Consequently, the elastically deformable struts 41C are positioned to project out the bottom of the outer blade case 43 and press against the upper edges 44A of the opening in the outer blade frame 44 when the outer blades 41 are mounted in the outer blade frame 44. The two outer blades 41 on either side of the triple bladed electric shaver are thereby allowed to press against the upper edges 44A of the opening in the outer blade frame 44. The two outside outer blades 41 have their deformable struts 41C disposed only on the sides of the blade supports 41B that allow pressure on the upper edges 44A of the opening in the outer blade frame 44. However, it is also possible to provide deformable struts on both sides of the blade supports using one side to press against the upper edge of the opening in the outer blade frame while floating the other side. The orientation for mounting in the outer blade case does not need to be specified for an outer blade unit with deformable struts on both sides.

The center outer blade 41 does not depend on deformable struts, but rather has coiled edge springs 16 at both ends to push the blade towards the skin. Consequently, there is no need to provide deformable struts on the blade support 41B for the center outer blade 41. The edge springs 16 press the center outer blade 41 against the skin with less pressure than the deformable struts but with a large in-out stroke. A triple bladed shaver with a center outer blade 41 that applies less pressure on the skin than the outer blades 41 on either side shaves with the center blade more compressed than the side blades when the shaver is near perpendicular to the skin. This puts all three blades in the same plane allowing both the side blades and the center blade to comfortably press against the skin.

The two side outer blades 41 mount in the outer blade case 43 in a manner allowing up and down movement. Therefore, vertical slits 9 are provided at both ends of the outer blade supports 41B. Guide projections 10 on the inside wall of the outer blade case 43 mate with the vertical slits 9. The outer blades 41 mount in the outer blade case 43 via the vertical slits 9 and the guide projections 10 allowing them to move up and down. When the outer blades 41 move up and down, the guide projections 10 move up and down within the vertical slits 9.

The center outer blade 41 mounts in the outer blade case 43 in a manner allowing up and down movement via a center blade stage 43C. As shown in FIG. 5, the outer blade case 43 is provided with a center blade stage 43C for mounting the center outer blade 41. The center outer blade 41 mates to the center blade stage 43C with edge springs 16 pushing upwards in a manner allowing up and down movement. The center blade stage 43C connects with the outer blade case 43 in a manner that does not allow up and down movement. Connection of the center outer blade 41 to the center blade stage 43C of the outer blade case 43 is by the same method that the two side outer blades 41 mount in the outer blade case 43. Namely, vertical slits 9 are provided at both ends of the outer blade support 41B, guide projections 12 which insert into the vertical slits 9 are provided on the center blade stage 43C, and the guide projections 12 slide within the vertical slits 9 allowing the outer blade 41 to move up and down.

The center blade stage 43C connects with the outer blade case 43 by insertion into connecting columns 43D provide on the inner walls of the outer blade case 43. A locking projection 13 at the lower end of each connecting column 43D catches in a locking hole 14 on the inserted center blade stage 43C to prevent disconnection of the center blade stage 43C.

Figure 14:
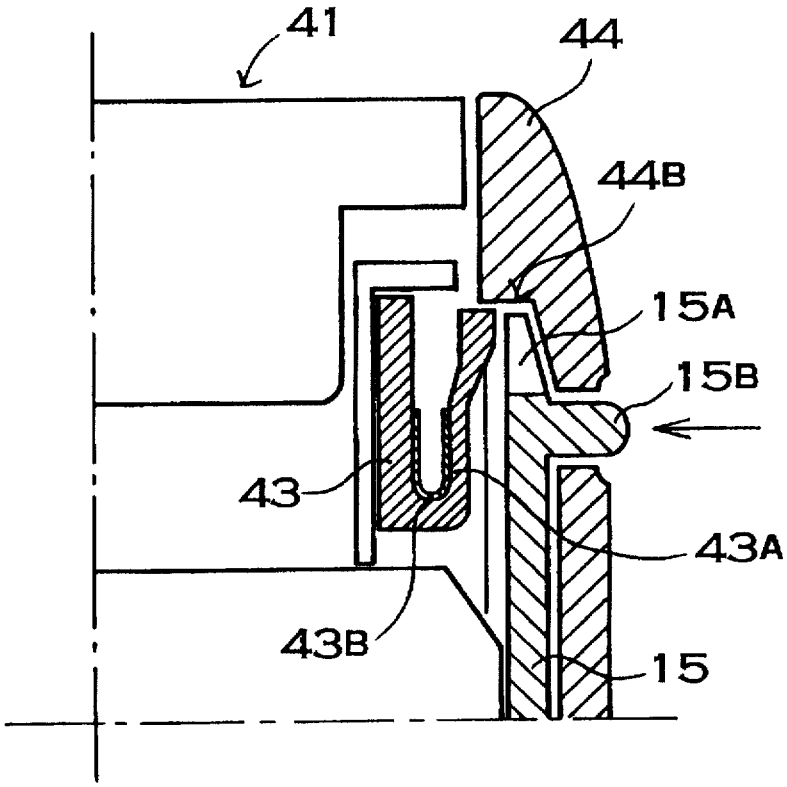
FIG. 14 is a cross-sectional view of the region where the outer blade case releases from the outer blade frame.

The outer blade case 43 mates with the outer blade frame 44 in a removable fashion. The outer blade case 43 is provided with latching pieces 43A which catch in latching detents 44B to mate the outer blade case 43 with the outer blade frame 44 in a removable fashion. The latching pieces 43A project out and upward from the lower portion of both ends of the outer blade case 43. As shown in FIG. 14, the latching pieces 43A have flexible sheet metal 43B on their inner surfaces giving them the ability to elastically deform. The upper ends of the latching pieces 43A are widened giving them a T-shape. The outer blade frame 44 is provided with latching detents 44B which are aligned to catch the latching pieces 43A when the outer blade case 43 is attached. When mounting the outer blade case 43 on the outer blade frame 44, the latching pieces 43A slide into the latching detents 44B.

Latch releases 15 are disposed within the outer blade frame 44 latching detents 44B to release the outer blade case 43 from the outer blade frame 44. Each latch release 15 is formed as a plate of flexible plastic. The lower portion of each latch release 15 is fixed to the case allowing the upper portion to deform elastically, Pressure rods 15A which push against both upper extremities of the T-shaped latching pieces 43A are formed as a single piece at the upper ends of each latch release 15. Further, push buttons 15B which project out through the case 8 are also formed as a single piece with each latch release 15. The push buttons 15B insert through holes in the case 8 in a manner allowing them to move in and out. The push buttons 15B are pressed to disconnect the outer blade case 43 from the outer blade frame 44. When the push buttons 15B are pressed, the pressure rods 15A push the latching pieces 43A out of the latching detents 44B releasing the lock between the outer blade case 43 and the outer blade frame 44 to disconnect the outer blade case 43 from the outer blade frame 44.

The outer blade frame 44 has an opening to accept the outer blade case 43 with a negligible gap. The upper edges 44A of the opening in the outer blade frame 44 align with the bottom edges of the outer blades 41. The upper edge 44A thickness at the opening is designed to allow pressure from the deformable struts 41C on the blade supports 41B. The outer blade frame 44 is preferably made of metal since it is part of the shaver case. In the illustrations, the outer blade frame 44 mounts on the electric shaver body in a removable fashion. However, it is also possible for the outer blade frame 44 to be integrated as one piece with the electric shaver body.

The outer blades 41, outer blade case 43, and outer blade frame 44 of the triple bladed shaver shown in FIG. 5 are assembled as follows.

① The center outer blade 41 is mated to the center blade stage 43C. Outer blade 41 vertical slits 9 mate with guide projections 12 to connect the outer blade 41 to the center blade stage 43C.

② Both side outer blades 41 and the center blade stage 43C with the center outer blade connected are arranged in parallel and mounted in the outer blade case 43. The outer blades 41 mount in the outer blade case 43 via the vertical slits 9 and the guide projections 10. The center blade stage 43C inserts into connecting columns 43D.

③ The outer blade case 43 with the three outer blades 41 mounted is inserted into the opening in the outer blade frame 44. Latching pieces 43A insert into latching detents 44B to hold the outer blade case 43 on the outer blade frame 44 in a manner that will not become disconnected easily.

In this state with the outer blades 41 mounted in the outer blade frame 44, the elastically deformable struts 41C press against the upper edges 44A of the opening in the outer blade frame 44. The outer blades 41 are pushed flexibly upward by the opposing reaction force to the elastically deformable struts 41C pressing against the upper edges 44A of the opening. Consequently, when the electric shaver is used and the outer blades press against the skin, each individual outer blade 41 is pressed flexibly against the skin for effective shaving.

The outer blade case 43 containing the outer blades 41 is disconnected from the outer blade frame 44 as follows.

① The push buttons 15B on the latch releases 15 are pressed.

② When the push buttons 15B are pressed, the latch releases 15 flexibly distort such that the upper portion pushes inward towards the inside of the outer blade frame 44.

③ The latch release 15 pressure rods 15A push the upper extremities of the T-shaped latching pieces 43A out of the latching detents 44B.

④ When the latching pieces 43A of the outer blade case 43 are pushed out of the outer blade frame 44 latching detents 44B, the outer blade case 43 and outer blade frame 44 become unlatched and disconnect.

⑤ When the outer blades 41 are pulled somewhat strongly to separate them from the outer blade case 43, the blade supports 41B and the outer blade case 43 distort slightly freeing the outer blade case 43 guide projections 10 from the vertical slits 9. This allows the outer blades 41 to be pulled from the outer blade case 41.

Figure 11:
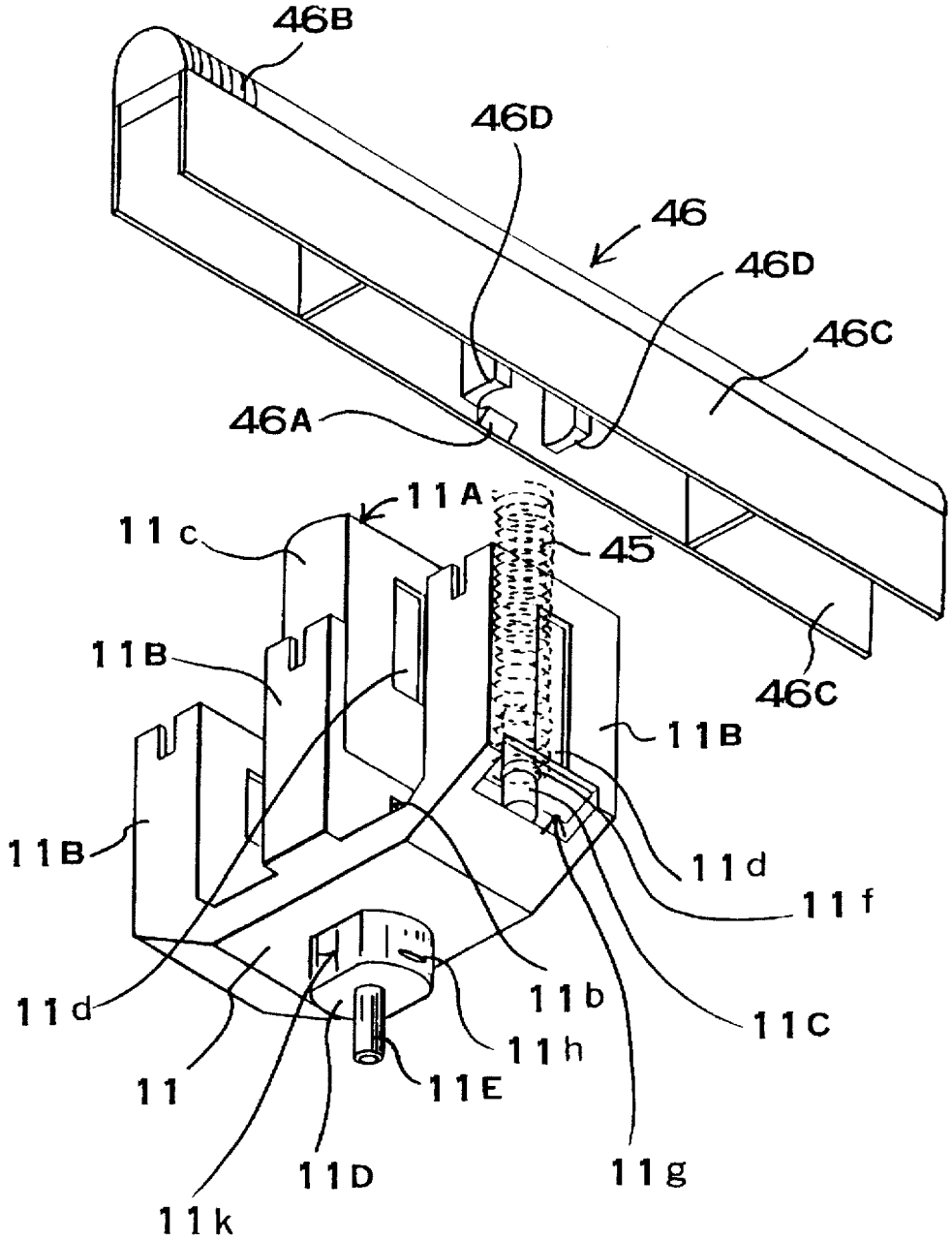
FIG. 11 is an oblique view of the inner blades and the inner blade stage of the triple bladed shaver shown in FIG. 4.
Figure 12:
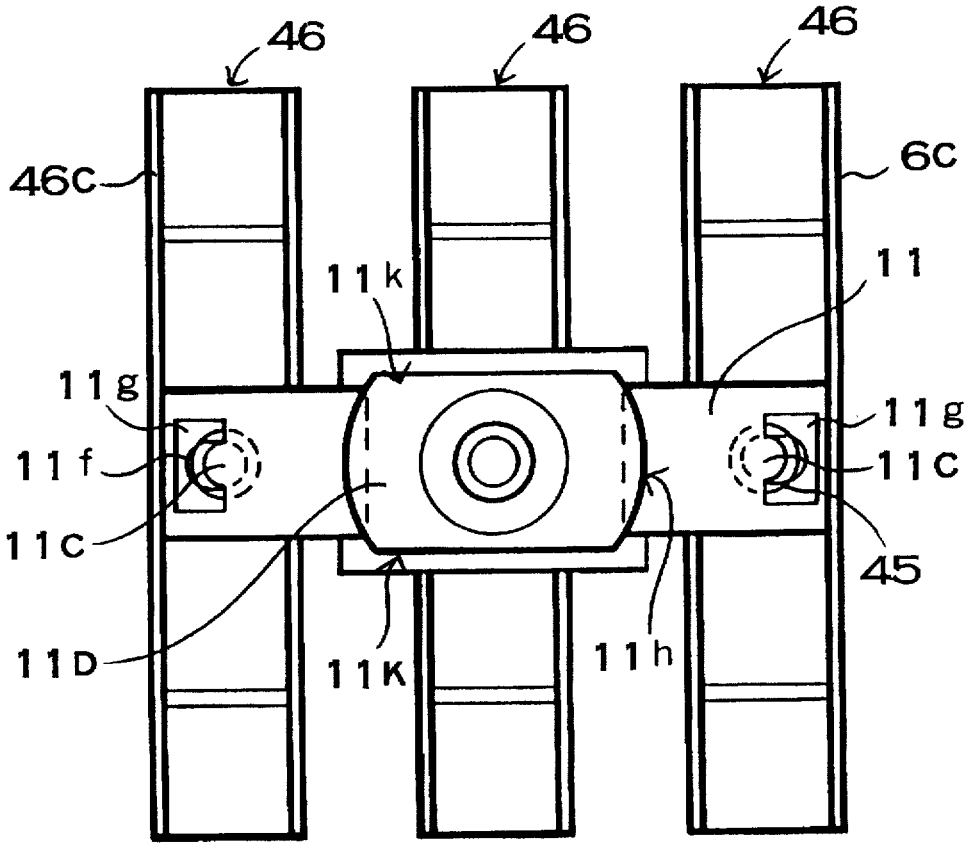
FIG. 12 is a bottom view of the inner blades and the inner blade stage.

The inner blade 46 shown in FIG. 11 is made by inserting a plurality of blade plates in plastic in a parallel fashion. The blade plates 46B are sheet metal formed with curved tops that allow them to contact the inner surface of the arch-shaped outer blades. The plastic body into which the blade plates 46B insert is made as a single piece with parallel side walls 46C disposed on opposite sides and a pair of connecting support struts 46D inside the side walls 46C. The connecting support struts 46D insert into the inner blade stage 11 vertical columns 11B. Each center spring 45, which pushes an inner blade 46 flexibly outward, is disposed between two connecting support struts 46D. Consequently, the separation between two connecting support struts 46D is designed slightly greater than the outer diameter of the center spring 45 to allow for its insertion. Further, As shown in FIG. 11, the opposing inner surfaces of the connecting support struts 46D are curved in a concave fashion to follow the surface of the center spring 45. Since the connecting support struts 46D insert into the inner blade stage 11 vertical columns 11B, the outside separation of the connecting support struts 46D is designed to be almost equal to the inside dimension of the vertical columns 11B.

Latching pieces 46A also are formed on the inner surfaces of the side walls 46C. The latching pieces 46A prevent inadvertent disconnection of the inner blades 46 from the inner blade stage 11. The latching pieces 46A are formed as a single piece with the inner blade side walls 46C and connecting support struts 46D and are located at the bottom inside edge at the center of the side walls 46C. Further, as shown in FIG. 11, the insertion surfaces of the latching pieces 46A are tapered and the latching pieces 46A are formed in hook shapes for smooth insertion and positive latching. When the inner blades 46 are connected to the inner blade stage 11, the latching pieces 46A insert into latching windows **11*d* in the vertical columns 11B to prevent separation. When the inner blade 46 connecting support struts 46D are inserted into the inner blade stage 11 vertical columns 11B, the side walls 46C elastically deform somewhat widening their separation as the latching pieces 46A are guided into latching windows 11*d* in the vertical columns 11B. When the latching pieces 46A lock into the latching windows 11*d*, the side wall 46C** separation narrows.

Since the connecting support struts 46D insert inside the inner blade stage 11 vertical columns 11B and the side walls 46C slide outside the vertical columns 11B, a space is provided between the side walls 46C and the connecting support struts 46D for vertical column 11B insertion.

The inner blade stage 11 is provided with three parallel vertical columns 11B to connect three rows of detachable inner blades 41. The three vertical columns 11B are formed as a single piece of plastic in the shape of rectangular columns. The three vertical columns 11B are joined together as a single unit at their bases. The inner blade stage 11 has a coupling rod 11E which projects from its base.

The three rows of inner blades 46 mount on the inner blade stage 11. The inner blades 46 on either side connect directly to the inner blade stage 11 while the center inner blade 46 connects to the inner blade stage 11 via the up-down stage 11A. As shown in FIG. 8, the up-down stage 11A connects with the inner blade stage 11 vertical column 11B in a manner capable of vertical movement due to the coiled center spring 45.

The lower end of the up-down stage 11A has retaining tabs 11*a* to avoid inadvertent disconnection of the up-down stage 11A from the vertical column 11B. The retaining tabs 11*a* prevent disconnection of the up-down stage 11A from the vertical column 11B by hooking on the upper edges of retaining slits 11*b* which extend vertically along the sides of the vertical column 11B. The up-down stage 11A inserts vertically into the vertical column 11B in a manner allowing movement up and down. To maintain the up-down stage 11A vertical, shallow grooves are formed in opposing sides of the vertical column 11B and the sliding surfaces 11*c* of the up-down stage 11A are made to conform to the grooved shapes. The center inner blade 46 is mounted on the upper end of the up-down stage 11A. The center inner blade 46 connects to the up-down stage 11A in a fixed manner that allows no up and down motion. This is because the up-down stage 11A itself provides the vertical motion to move the center inner blade 46 up and down. The upper end of the up-down stage 11A has latching windows 11*d* on both sides to mate with inner blade 46 latching pieces in the same fashion as the vertical columns 11B on either side of the center. The up-down stage 11A is formed in the shape of a rectangular column capable of housing a center spring 45, and a base plate 11*e* is provided in the middle to press against the upper end of the center spring 45. A projection is formed on the underside of the base plate 11*e* to mate with the upper end of the center spring 45.

The inner blade stage 11 vertical columns 11B are provided with insertion rods 11C inside their bases for aligning the center springs 45. As shown in FIG. 11, retaining flanges 11*f* which project out from the surface of the insertion rods 11C to hold the center springs 45 are formed as a single piece with the insertion rods 11C. The retaining flanges 11*f* insert between coils of the spiral coiled center springs 45 to hold them in place. Consequently, retaining flange 11*f* width is designed to fit between adjacent center spring 45 coils. The retaining flanges 11*f* hold the bottom ends of the center springs 45 and prevent their disconnection from the insertion rods 11C when the inner blades 46 are removed from the inner blade stage 11. However, if the center springs 45 are strongly pulled or twisted and pulled, the center springs 45 will deform or unscrew from the retaining flanges 11*f* and become disconnected.

As shown in FIGS. 8 and 11, windows 11*g* are established at the bases of the vertical columns 11B on both sides of center at the bottom of the retaining flanges 11*f*. The retaining flanges 11*f* are disposed at the top of the windows 11*g* and on one side of the insertion rods 11C. With this configuration, the vertical columns 11B and the insertion rods 11C of the inner blade stage 11 can be formed as a single piece of plastic. This is because a mold for forming the insertion rods 11C with retaining flanges 11*f* can be separated downward from the plastic part using windows 11*g*. Consequently, this type of inner blade stage 11 can be simply and inexpensively produced in quantity. However, these window 11*g* are not necessary if the insertion rods 11C and vertical columns 11B are made as separate parts of plastic or metal and the insertion rods 11C are then fixed to the bases of the vertical columns 11B. In an inner blade stage 11 using insertion rods 11C and vertical columns 11B as separate parts, the retaining flanges 11*f* can be established around the entire perimeters of the insertion rods 11C. The vertical position of each retaining flange 11*f* on each insertion rod 11C is designed to be the position at which the lower end of the center spring 45 is held on the insertion rod 11C.

As mentioned previously, vertical slit latching windows 11*d* are provided through both sides of the inner blade stage 11 vertical columns 11B to mate with latching pieces 46A on the inner blades 46 to prevent their inadvertent separation. However, the inner blades 46 can be removed from the inner blade stage 11 with a strong pull to disconnect the latching pieces 46A from the latching windows 11*d*.

The center springs 45 mate with the insertion rods 11C provided on the inner blade stage 11 and along with the up-down stage 11A push the inner blades 46 flexibly upward. Pushed upward by the inner springs 45, the inner blades 46 press flexibly against the inner surfaces of the outer blades 41 to effectively cut whiskers that pass through the outer blades 41.

The inner blades 46 are connected or disconnected from the inner blade stage 11 in this configuration of shaver as follows.

① The center springs 45 are inserted into the vertical columns 11B of the inner blade stage 11. This is accomplished by mating each center spring with an insertion rod 11C and either twisting or pushing the spring with some force to insert the insertion rod 11C retaining flange 11*f* between spring coils. Namely, each center spring is inserted into a vertical column such that the insertion rod 11C retaining flange 11*f* catches on the center spring 45.

② After the up-down stage 11A is inserted into the center vertical column 11B, the inner blades 46 are mounted on the inner blade stage 11 by inserting the inner blade 46 connecting support struts 46D into the inner blade stage 11 vertical columns 11B and up-down stage 11A. When this is done, the inner blade 46 side walls 46C elastically deform somewhat widening their separation to allow latching pieces 46A on their inner surfaces to mate with latching windows 11*d* in the vertical columns 11B or up-down stage 11A. When the inner blades 46 on either side of center are mounted on the inner blade stage 11, their latching pieces 46A are held in latching windows 11*d* to prevent disconnection. When the center inner blade 46 is mounted on the up-down stage 11A, its latching pieces 46A are also held in latching windows 11*d* to prevent disconnection. In the mounted state, the center springs 45 push the inner blades 46 upward either directly or via the up-down stage 11A. Consequently, when the outer blades 41 are attached outside the inner blades 46 (not illustrated), the inner blades 46 press flexibly against the inner surfaces of the outer blades 41.

③ When cleaning shaved whiskers, the inner blades 46 are somewhat strongly pulled to remove them from the inner blade stage 11. When the inner blades 46 are strongly pulled, the side walls 46C elastically deform to release the latching pieces 46A from the vertical column 11B latching windows 11*d*. The center inner blade 46 separates from the up-down stage 11A similarly.

④ Even when the inner blades 46 are removed from the inner blade stage 11, the center springs 45 will not spring out of the inner blade stage 11 because the lower ends of the center springs 45 are latched by the insertion rod 11C latching pieces 46A.

⑤ After cleaning, the inner blades 46 are mounted on the inner blade stage 11 and the electric shaver can be used.

The triple bladed shaver with the configuration described above is characterized in that both ends of the center outer blade press against the skin in good balance for a comfortable shave. This is possible because edge springs are disposed at both ends of the center outer blade between the center outer blade and the outer blade case, and these edge springs push both ends of the center outer blade flexibly outward towards the skin. With the addition of the inner blade pressing against its inner surface, the in-out stroke of the center outer blade with edge springs at both ends can be lengthened and still press comfortably against the skin for efficient shaving.

Further, a shaver with the center outer blade connected to the outer blade case via a center blade stage has the feature that the three outer blades can be easily connected to the outer blade case. The center outer blade can be mounted in the outer blade case after the two outer blades on either side have been mounted. In addition, since the center outer blade can be attached or removed from the outer blade case separately from the outer blades on either side, the center outer blade, which receives the most wear, can be made and sold as a separate part from the side outer blades. This type of triple bladed shaver therefore has the feature that replacement parts cost is reduced.

Finally, a shaver with its center inner blade connected to the inner blade stage via an up-down stage and both its side inner blades connected directly to the inner blade stage has the feature that the in-out stroke of the center inner blade can be made longer than that of the two side inner blades.

As this invention may be embodied in several forms without departing from the spirit of the essential characteristics thereof, the present embodiment is therefore illustrative and not restrictive, since the scope of the invention is defined by the appended claims rather than by the description preceding them, and all changes that fall within the metes and bounds of the claims or equivalents of such metes and bounds thereof are therefore intended to be embraced by the claims.

We claim:

1. A triple bladed shaver arrangement, comprising:

three rows of outer blades including a center outer blade and side outer blades, each side outer blade comprising a plastic support having an integrally formed elastically deformable strut protruding downward from a bottom of said plastic support and curved arch-shaped mesh blades fixed on said supports, said outer blades each having respective inner surfaces;

an outer blade case having said center outer blade and side outer blades mounted there in, said center outer blade protruding upwardly more than said side outer blades and being mounted in said outer blade case so as to be capable of free reciprocal movement;

three rows of inner blades arranged parallel with respect to each other and pressing on said inner surfaces of said outer blades; and edge springs disposed between ends of said center outer blade and said outer blade case flexibly biasing said center outer blade outward of said outer blade case.

2. The arrangement of claim 1, wherein said elastically deformable struts are rod-shaped members.

3. The arrangement of claim 1, wherein each of said outer blade supports of said side outer blades have elastically deformable struts extending toward opposite ends of said outer blade support.

4. The arrangement of claim 3, wherein said elastically deformable struts on each of said outer blade supports slants on a declivity from the middle of said outer blade support toward the opposite ends.

5. The arrangement of claim 1, wherein said outer blade case is detachably mounted in an opening of an outer blade frame.

6. The arrangement of claim 5, wherein said opening of said outer blade frame has edges and said elastically deformable struts press flexibly against said edges of said opening such that said side outer blades are flexibly biased outward of said outer blade frame.

7. A triple bladed shaver arrangement, comprising:

three rows of outer blades comprising a center outer blade and side outer blades, each of said outer blades comprising a mesh blade having an arch-shape mounted on a support and an inner surface;

an outer blade case having said outer blades mounted therein with said side outer blades being mounted for free reciprocal movement in inward and outward directions of said outer blade case;

a center blade stage having said center outer blade mounted therein such that said center outer blade protrudes further in the outward direction of said outer blade case relative to said side outer blades, said center outer blade being mounted to said center blade stage so as to be capable of free reciprocal movement in the inward and outward directions of said outer blade case;

edge springs positioned between said center outer blade and said center blade stage at ends of said center outer blade, said edge springs flexibly biasing said center outer blade in the outward direction from said center blade stage; and three rows of inner blades that are arranged so as to be parallel with respect to each other and to press on said inner surfaces of said outer blades.

8. The arrangement of claim 7, wherein said center glade is fixed relative to said outer blade case.

9. The arrangement of claim 7, wherein said outer blade case comprises connecting slots receiving ends of said center blade stage and connecting said center blade stage to said outer blade case.

10. A triple bladed shaver arrangement, comprising:

three rows of outer blades including a center outer blade and side outer blades, each side outer blade comprising a plastic support having an integrally formed elastically deformable strut protruding downward from a bottom of said plastic support and curved arch-shaped mesh blades fixed on said supports, said outer blades each having respective inner surfaces;

an outer blade case having said outer blades mounted therein with said side outer blades being mounted for free reciprocal movement in inward and outward directions of said outer blade case;

a center blade stage having said center outer blade mounted therein such that said center outer blade protrudes further in the outward direction of said outer blade case relative to said side outer blades, said center outer blade being mounted to said center blade stage so as to be capable of free reciprocal movement in the inward and outward directions of said outer blade case;

edge springs positioned between said center outer blade and said center blade stage at ends of said center outer blade, said edge springs flexibly biasing said center outer blade in the outward direction from said center blade stage; and three rows of inner blades that are arranged so as to be parallel with respect to each other and to press on said inner surfaces of said outer blades.

11. The arrangement of claim 10, wherein said elastically deformable struts are rod-shaped members.

12. The arrangement of claim 10, wherein each of said outer blade supports of said side outer blades have elastically deformable struts extending toward opposite ends of said outer blade support.

13. The arrangement of claim 12, wherein said elastically deformable struts on each of said outer blade supports slants on a declivity from the middle of said outer blade support toward the opposite ends.

14. The arrangement of claim 10, wherein said outer blade case is detachably mounted in an opening of an outer blade frame.

15. The arrangement of claim 14, wherein said opening of said outer blade frame has edges and said elastically deformable struts press flexibly against said edges of said opening such that said side outer blades are flexibly biased outward of said outer blade frame.

16. The arrangement of claim 10, wherein said center glade is fixed relative to said outer blade case.

17. The arrangement of claim 10, wherein said outer blade case comprises connecting slots receiving ends of said center blade stage and connecting said center blade stage to said outer blade case.

* * * * *